US009022064B2

(12) United States Patent
Deng

(10) Patent No.: US 9,022,064 B2
(45) Date of Patent: May 5, 2015

(54) DUAL FUEL CONTROL DEVICE WITH AUXILIARY BACKLINE PRESSURE REGULATOR

(71) Applicant: David Deng, Diamond Bar, CA (US)

(72) Inventor: David Deng, Diamond Bar, CA (US)

( * ) Notice: Subject to any disclaimer, the term of this patent is extended or adjusted under 35 U.S.C. 154(b) by 0 days.

(21) Appl. No.: 13/791,602

(22) Filed: Mar. 8, 2013

(65) Prior Publication Data

US 2013/0299022 A1 Nov. 14, 2013

Related U.S. Application Data

(60) Provisional application No. 61/748,056, filed on Dec. 31, 2012.

(30) Foreign Application Priority Data

May 10, 2012 (CN) ..... 2012 1 0143737
Sep. 13, 2012 (CN) ..... 2012 1 0337908
Sep. 13, 2012 (CN) ..... 2012 2 0465982 U

(51) Int. Cl.
*F16K 31/36* (2006.01)
*F23C 1/00* (2006.01)
*F23N 1/00* (2006.01)

(52) U.S. Cl.
CPC . *F23C 1/00* (2013.01); *F23N 1/005* (2013.01); *F23N 2023/38* (2013.01); *F23N 2035/14* (2013.01); *F23N 2035/20* (2013.01); *F23N 2035/24* (2013.01)

(58) Field of Classification Search
USPC ..... 126/116 A, 116 R, 25 R, 58, 85 R; 137/488, 489.5, 505.12
See application file for complete search history.

(56) References Cited

U.S. PATENT DOCUMENTS 1,639,115 A 8/1927 Smith
2,319,676 A 5/1943 Guelson
2,380,956 A 8/1945 Evarts
(Continued)

FOREIGN PATENT DOCUMENTS

DE 113 680 C 11/1899
DE 1650303 9/1970
(Continued)

OTHER PUBLICATIONS

International Search Report and Written Opinion for International Application No. PCT/US2012/034983, Notification mailed Jul. 24, 2012.
(Continued)

*Primary Examiner* — John K Fristoe, Jr.
*Assistant Examiner* — R.K. Arundale
(74) *Attorney, Agent, or Firm* — Knobbe Martens Olson & Bear LLP

(57) ABSTRACT

A heater assembly can be used with a gas appliance. The gas appliance can be a dual fuel appliance for use with one of a first fuel type or a second fuel type different than the first. The heater assembly can include a fuel regulator valve including a main pressure regulator to regulate the fuel pressure, at least one auxiliary pressure regulator, a first fuel source connection for connecting the first fuel type to the heater assembly, and a second fuel source connection for connecting the second fuel type to the heater assembly. The one or more auxiliary pressure regulators introduce a backline pressure to the main pressure regulator, thereby adjusting the fuel pressure to fall within a predetermined range.

18 Claims, 12 Drawing Sheets

(56) References Cited

U.S. PATENT DOCUMENTS

| | | | | |
|---|---|---|---|---|
| 2,422,368 | A | 6/1947 | Bay | |
| 2,464,697 | A | 3/1949 | Logan et al. | |
| 2,518,894 | A | 8/1950 | Humbarger et al. | |
| 2,556,337 | A | 6/1951 | Paille | |
| 2,630,821 | A | 3/1953 | Arey | |
| 2,661,157 | A | 12/1953 | Reichelderfer | |
| 2,687,140 | A | 8/1954 | St. Clair | |
| 2,905,361 | A | 9/1959 | Noall | |
| 2,969,924 | A | 1/1961 | William | |
| 3,001,541 | A | 9/1961 | St. Clair | |
| 3,032,096 | A | 5/1962 | Stout et al. | |
| 3,331,392 | A | 7/1967 | Davidson et al. | |
| 3,357,443 | A | 12/1967 | Brumm | |
| 3,386,656 | A | 6/1968 | Bergquist | |
| 3,430,655 | A | 3/1969 | Forney | |
| 3,578,015 | A | 5/1971 | Andersen | |
| 3,654,948 | A * | 4/1972 | Nelson | 137/118.07 |
| 3,747,629 | A | 7/1973 | Bauman | |
| 3,814,570 | A | 6/1974 | Guigues et al. | |
| 3,829,279 | A | 8/1974 | Qualley et al. | |
| 3,939,871 | A | 2/1976 | Dickson | |
| 3,977,423 | A * | 8/1976 | Clayton | 137/12 |
| 4,021,190 | A | 5/1977 | Dickson | |
| 4,101,257 | A | 7/1978 | Straitz, III | |
| 4,290,450 | A | 9/1981 | Swanson | |
| 4,301,825 | A | 11/1981 | Simko | |
| 4,359,284 | A | 11/1982 | Kude et al. | |
| 4,465,456 | A | 8/1984 | Hynek et al. | |
| 4,515,554 | A | 5/1985 | Sirand | |
| 4,566,488 | A | 1/1986 | Chow et al. | |
| 4,653,530 | A | 3/1987 | Kelly | |
| 4,718,448 | A | 1/1988 | Love et al. | |
| 4,768,543 | A | 9/1988 | Wienke et al. | |
| 4,796,652 | A | 1/1989 | Hafla | |
| 4,930,538 | A | 6/1990 | Browne | |
| 5,063,956 | A | 11/1991 | Borcuch et al. | |
| 5,172,728 | A | 12/1992 | Tsukazaki | |
| 5,379,794 | A | 1/1995 | Brown | |
| 5,413,141 | A | 5/1995 | Dietiker | |
| 5,458,294 | A | 10/1995 | Zachary et al. | |
| 5,584,680 | A | 12/1996 | Kim | |
| 5,591,024 | A | 1/1997 | Eavenson et al. | |
| 5,807,098 | A | 9/1998 | Deng | |
| 5,971,746 | A | 10/1999 | Givens et al. | |
| 5,975,112 | A | 11/1999 | Ohmi et al. | |
| 5,988,204 | A | 11/1999 | Reinhardt et al. | |
| 6,035,893 | A | 3/2000 | Ohmi et al. | |
| 6,135,063 | A | 10/2000 | Welden | |
| 6,257,270 | B1 | 7/2001 | Ohmi et al. | |
| 6,354,078 | B1 | 3/2002 | Karlsson et al. | |
| 6,607,854 | B1 | 8/2003 | Rehg et al. | |
| 6,786,194 | B2 | 9/2004 | Koegler et al. | |
| 6,904,873 | B1 | 6/2005 | Ashton | |
| 6,910,496 | B2 | 6/2005 | Strom | |
| 6,938,634 | B2 | 9/2005 | Dewey, Jr. | |
| 6,941,962 | B2 | 9/2005 | Haddad | |
| 7,013,886 | B2 | 3/2006 | Deng | |
| 7,044,729 | B2 | 5/2006 | Ayastuy et al. | |
| 7,386,981 | B2 | 6/2008 | Zielinski et al. | |
| 7,487,888 | B1 | 2/2009 | Pierre, Jr. | |
| 7,533,656 | B2 | 5/2009 | Dingle | |
| 7,600,529 | B2 | 10/2009 | Querejeta | |
| 7,607,426 | B2 | 10/2009 | Deng | |
| 7,654,820 | B2 | 2/2010 | Deng | |
| 7,677,236 | B2 | 3/2010 | Deng | |
| 7,967,006 | B2 | 6/2011 | Deng | |
| 8,011,920 | B2 | 9/2011 | Deng | |
| 8,152,515 | B2 | 4/2012 | Deng | |
| 8,241,034 | B2 | 8/2012 | Deng | |
| 2006/0096644 | A1 | 5/2006 | Goldfarb et al. | |
| 2006/0236986 | A1 | 10/2006 | Fujisawa | |
| 2007/0154856 | A1 | 7/2007 | Hallit et al. | |
| 2007/0215223 | A1 | 9/2007 | Morris | |
| 2008/0149872 | A1 | 6/2008 | Deng | |
| 2008/0153045 | A1 | 6/2008 | Deng | |
| 2010/0310997 | A1 | 12/2010 | Mugica Odriozola et al. | |
| 2010/0326430 | A1 | 12/2010 | Deng | |
| 2010/0330513 | A1 | 12/2010 | Deng | |
| 2011/0143294 | A1 | 6/2011 | Deng | |
| 2011/0226355 | A1 | 9/2011 | Benvenuto et al. | |
| 2014/0186783 | A1 * | 7/2014 | Deng | 431/281 |

FOREIGN PATENT DOCUMENTS

| | | | |
|---|---|---|---|
| DE | 1959677 | | 5/1971 |
| DE | 3700233 | A1 | 7/1988 |
| DE | 19543018 | | 5/1997 |
| EP | 0509626 | | 10/1992 |
| EP | 1326050 | | 7/2003 |
| EP | 1970625 | | 9/2008 |
| FR | 2151367 | | 3/1973 |
| GB | 19845 | | 2/1913 |
| GB | 1136468 | | 12/1968 |
| GB | 1381887 | | 1/1975 |
| GB | 1424711 | | 2/1976 |
| GB | 2210155 | | 6/1989 |
| GB | 2298039 | | 8/1996 |
| JP | 58 219320 | A | 12/1983 |
| JP | 59009425 | | 1/1984 |
| JP | 03 230015 | A | 10/1991 |
| JP | 05-256422 | | 5/1993 |
| JP | 10141656 | | 5/1998 |
| JP | 11192166 | | 7/1999 |
| JP | 2000234738 | | 8/2000 |
| JP | 2003 056845 | A | 2/2003 |
| JP | 2003 074837 | A | 3/2003 |
| JP | 2003-74838 | | 12/2003 |

OTHER PUBLICATIONS

International Search Report and Written Opinion for International Application No. PCT/US2011/039521, Notification mailed Mar. 18, 2013.

International Search Report and Written Opinion for International Application No. PCT/US2011/039524, Notification mailed Mar. 13, 2013.

International Search Report and Written Opinion for International Application No. PCT/US2011/039525, Notification mailed Apr. 5, 2013.

International Search Report and Written Opinion for International Application No. PCT/US2011/039526, Notification mailed Mar. 28, 2013.

International Search Report and Written Opinion for International Application No. PCT/US2013/040202, Notification mailed Sep. 6, 2013.

Gas Hearth Systems Reference Manual, Chapter 18: Millivolt Gas Control Valves, Jun. 2006.

* cited by examiner

DUAL FUEL CONTROL DEVICE WITH AUXILIARY BACKLINE PRESSURE REGULATOR

CROSS-REFERENCE TO RELATED APPLICATIONS

Any and all applications for which a foreign or domestic priority claim is identified in the Application Data Sheet as filed with the present application, are hereby incorporated by reference under 37 CFR 1.57. This application claims priority to U.S. Provisional Appl. No. 61/748056 (PROCUSA.098PR), filed Dec. 31, 2012. This application also claims priority to Chinese Pat. Appl. No. 201210143737.X, filed May 10, 2012 titled Dual Fuel Regulator with Automatic Pilot and Main Burner Orifice Selection with dual Solenoids, Chinese Pat. Appl. No. 201210337908.2, filed Sep. 13, 2012 titled No Step Dual Fuel Heating Control System, and Chinese Pat. Appl. No. 201220465982.8, filed Sep. 13, 2012 titled No Step Dual Fuel Heating Control System. This application is also related to U.S. patent application Ser. No. 13/311,402 (PROCUSA.091A), filed Dec. 5, 2011. All of the above applications are hereby incorporated herein by reference in their entirety and are to be considered a part of this specification.

BACKGROUND OF THE INVENTION

1. Field of the Invention

Certain embodiments disclosed herein relate generally to a heating apparatus for use in a gas appliance particularly adapted for dual fuel use. The heating apparatus can be, can be a part of, and can be used in or with many different appliances, including, but not limited to: heaters, boilers, dryers, washing machines, ovens, fireplaces, stoves, water heaters, barbeques, etc.

2. Description of the Related Art

Many varieties of appliances, such as heaters, boilers, dryers, washing machines, ovens, fireplaces, stoves, and other heat-producing devices utilize pressurized, combustible fuels. Some such devices operate with liquid propane, while others operate with natural gas. However, such devices and certain components thereof have various limitations and disadvantages. Therefore, there exists a constant need for improvement in appliances and components to be used in appliances.

SUMMARY OF THE INVENTION

A heater assembly can be used with one of the first fuel type or a second fuel type different than the first. The heater assembly can include at least one fuel regulator device which includes a main pressure regulator and an auxiliary pressure regulator. The main pressure regulator can include a diaphragm and a valve. The diaphragm can have a front side and a back side. The main pressure regulator regulates a fluid pressure for a fuel of a first fuel type or a second fuel type to within a pressure range. The regulator valve is connected to the diaphragm to control the fluid flow of the fuel on the front side of the diaphragm. At certain pressures, the auxiliary pressure regulator directs fuel to the backside of the diaphragm of the main pressure regulator. This creates a back pressure on the diaphragm that adjusts the pressure range of the main pressure regulator.

In some embodiments, a heater assembly may include a fuel regulator that comprises a first fuel source connection for connecting a first fuel type to the heater assembly, a second fuel source connection for connecting a second fuel type to the heater assembly, a main pressure regulator, a first auxiliary pressure regulator, and a second auxiliary pressure regulator. The main pressure regulator can include a diaphragm and a valve. The main pressure regulator regulates a fluid pressure for the fuel. At certain pressures, the auxiliary pressure regulator directs fuel to the backside of the diaphragm of the main pressure regulator to adjust the fuel pressure. If the second fuel source connection is engaged, fuel is not permitted to flow to the second auxiliary pressure regulator.

In some embodiments, a heater assembly may include a fuel regulator valve that comprises a first fuel source connection for connecting a first fuel type to the heater assembly, a second fuel source connection for connecting a second fuel type to the heater assembly, a main pressure regulator, a first auxiliary pressure regulator, a second auxiliary pressure regulator, and a flowpath valve. The main pressure regulator can include a diaphragm and a valve. The main pressure regulator regulates a fluid pressure for the fuel. At certain pressures, the auxiliary pressure regulator directs fuel to the backside of the diaphragm of the main pressure regulator to adjust the fuel pressure. The flowpath valve allows the first fuel type, but not the second fuel type, to flow to the second auxiliary pressure regulator.

The fuel regulator may include an actuation member. The actuation member can be configured to control the position of the flowpath valve and determine if the fluid flow is provided to the second auxiliary pressure regulator. If the fluid flow is provided, then a second back pressure is created on the diaphragm of the main pressure regulator.

In other embodiments, a heater assembly may include a fuel regulator that comprises a first fuel source connection for connecting a first fuel type to the heater assembly, a second fuel source connection for connecting a second fuel type to the heater assembly, a main pressure regulator, a first auxiliary pressure regulator, a second auxiliary pressure, a first flowpath, a second flowpath, and a flowpath selector. The main pressure regulator, which includes a diaphragm and a valve, regulates the fuel pressure. At certain pressures, both auxiliary pressure regulators can direct fuel to the backside of the diaphragm of the main pressure regulator to adjust the fuel pressure. The first flowpath directs a portion of the fuel to the first auxiliary pressure regulator, while the second flowpath directs a portion of fuel to the second auxiliary pressure regulator. Fuel along both flowpaths eventually reaches the backside of the diaphragm of the main pressure regulator. The flowpath selector has a first position that blocks fuel flow along the second flowpath, and a second position that permits fuel to flow along the second flowpath. The flowpath selector position depends upon which fuel source connection is engaged. In one embodiment, the flowpath selector is in the first position when the second fuel source connection is engaged. Furthermore, when the first fuel source connection is engaged, the flowpath selector is in the second position.

The fuel regulator valve may also include an actuation member. The actuation member can be configured such that connecting a fuel source to the first fuel source connection moves the actuation member from the first position to the second position which causes the flowpath selector to move from its first position to its second position. The second flowpath allows the main pressure regulator to regulate a fuel flow of the first fuel type within a predetermined range.

The heater assembly can further include additional valves and connections that can also be controlled with the actuation member. The heater assembly can also include an additional actuation member.

The fuel regulator valve may also include a second actuation member. The second actuation member can be configured such that connecting a fuel source to the second fuel source connection moves the second actuation from a first position to a second position. The flowpath selector remains in its first position. The first flowpath allows the main pressure regulator to regulate a fuel flow of the second fuel type within a predetermined range different from the predetermined range of the first fuel type. The second actuation member can be configured to open a main burner center orifice valve when the member moves from first position to second position. Opening the main burner center orifice valve allows the fuel to flow out of both the main burner center orifice and the main burner outer orifices. A closed main burner center orifice valve, on the other hand, only allows the fuel to discharge from the fuel regulator valve via the main burner outer orifices. This occurs when the first fuel source connection is engaged, meaning the second actuation member remains in its first position.

The actuation member can comprise a rod configured for linear advancement along its longitudinal axis from the first position to the second position. The rod can extend along a longitudinal axis and have a plurality of longitudinal cross-sections of different shapes.

BRIEF DESCRIPTION OF THE DRAWINGS

These and other features, aspects and advantages are described below with reference to the drawings, which are intended to illustrate but not to limit the invention. In the drawings, like reference characters denote corresponding features consistently throughout similar embodiments.

DETAILED DESCRIPTION OF THE PREFERRED EMBODIMENT

Many varieties of space heaters, fireplaces, stoves, ovens, boilers, fireplace inserts, gas logs, and other heat-producing devices employ combustible fuels, such as liquid propane and natural gas. These devices generally are designed to operate with a single fuel type at a specific pressure. For example, as one having skill in the art would appreciate, some gas heaters that are configured to be installed on a wall or a floor operate with natural gas at a pressure in a range from about 3 inches of water column to about 6 inches of water column, while others operate with liquid propane at a pressure in a range from about 8 inches of water column to about 12 inches of water column.

In many instances, the operability of such devices with only a single fuel source is disadvantageous for distributors, retailers, and/or consumers. For example, retail stores often try to predict the demand for natural gas units versus liquid propane units over a given season, and accordingly stock their shelves and/or warehouses with a percentage of each variety of device. Should such predictions prove incorrect, stores can be left with unsold units when the demand for one type of unit was less than expected, while some potential customers can be left waiting through shipping delays or even be turned away empty-handed when the demand for one type of unit was greater than expected. Either case can result in financial and other costs to the stores. Additionally, some consumers can be disappointed to discover that the styles or models of stoves, fireplaces or other device, with which they wish to improve their homes, are incompatible with the fuel sources with which their homes are serviced.

Certain advantageous embodiments disclosed herein reduce or eliminate these and other problems associated with devices having heating sources that operate with only a single type of fuel source. Furthermore, although certain of the embodiments described hereafter are presented in the context of vent-free heating systems, the apparatus and devices disclosed and enabled herein can benefit a wide variety of other applications and appliances.

Figure 1:
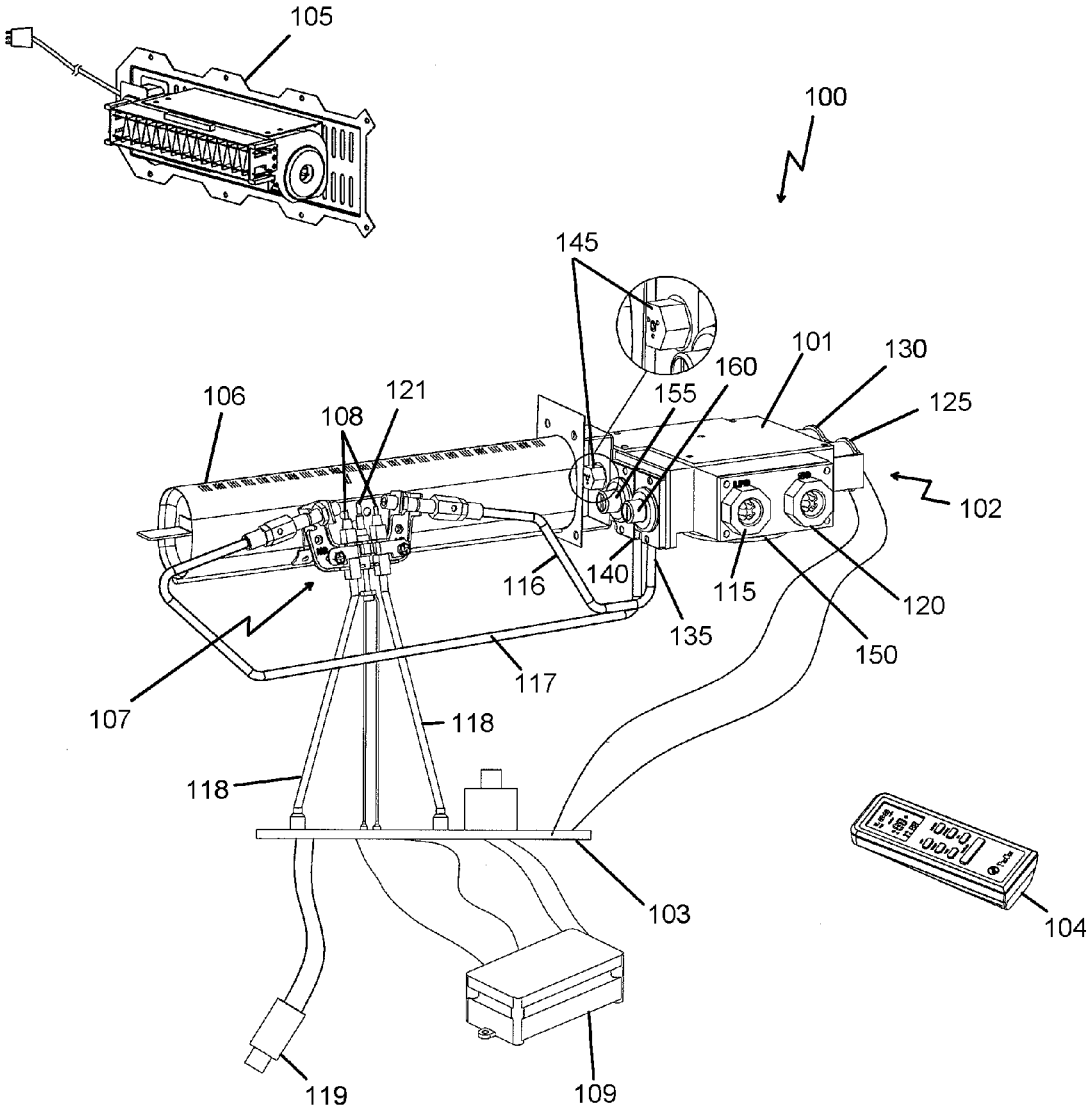
FIG. 1 is a perspective view of one embodiment of a heater configured to operate using either a first fuel source or a second fuel source.

FIG. 1 illustrates various components of a heater. In the illustrated heater, the outer housing is not shown for convenience of illustration. But, it will be understood that the various components can be enclosed in a housing with one or more vents and/or windows to provide heat for any number of various uses. The heater can be configured for a variety of heaters, such as vent-free infrared heaters, vent-free blue flame heaters, or other types of heaters, such as direct vent heaters. In some embodiments, the heater configured for boilers, stoves, dryers, fireplaces, gas logs, etc. In some embodiments, the heater is configured for a portable heater. Other configurations of the heater are also possible.

In some embodiments, the heater can have heater assembly 100 where one or more components of the heater can be combined in a single unit. The unit can comprise one or more housings that may be directly or indirectly coupled together. In some embodiments, such as that illustrated on FIGS. 1 and 2, the heater assembly can include fuel hook-ups or inlets 115, 120, a pressure regulator or fuel regulator valve 101, a main control valve 102 and a burner nozzle 145. The heater assembly can also simplify the heater by replacing many of the various pipes, fluid flow controllers, and switching valves with the housing and assembly. This can be especially advantageous where the heating assembly 100 is configured for use with one fuel but is user selectable between two or more different fuels, such as natural gas and liquid propane.

Figure 2:
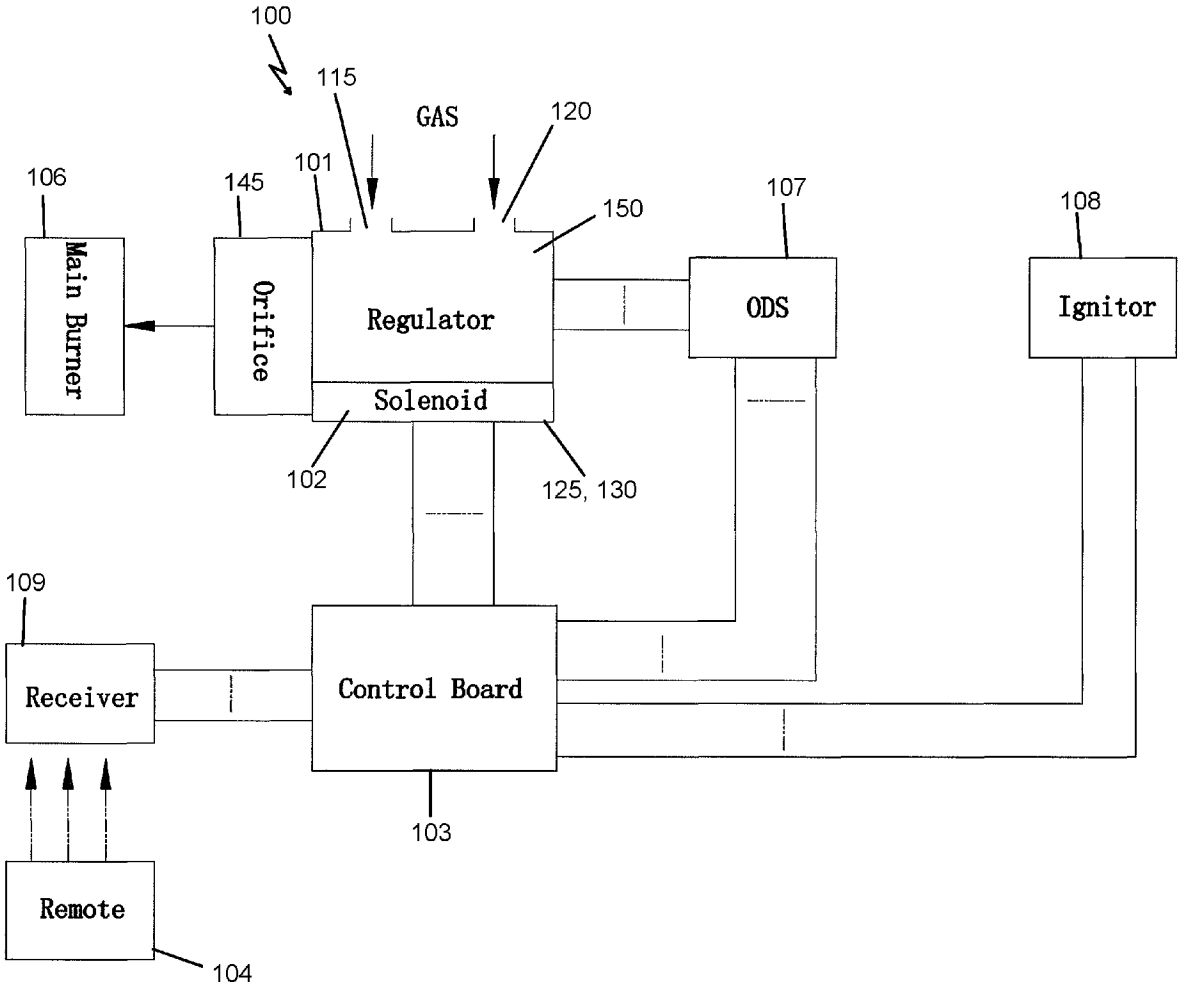
FIG. 2 is a schematic representation of one embodiment of a heater.

Continuing with reference to FIGS. 1 and 2, fuel can be provided to the heater assembly 100. The heater assembly 100 can direct the fuel to be combusted at a main burner 106 through the burner nozzle 145. In some embodiments, the burner nozzle 145 is not part of the heater assembly 100. The fuel received by the main burner 106 can be a first fuel or second fuel provided by the fuel regulator valve 101. The fuel discharged at the burner nozzle 145 and received by the main burner 106 can be a fluid, which may be a gas, liquid, or combination thereof. For purposes of brevity, recitation of the term "gas or liquid" hereafter shall also include the possibility of a combination of a gas and a liquid. In addition, as used herein, the term "fluid" is a broad term used in its ordinary sense, and includes materials or substances capable of fluid flow, such as gases, liquids, and combinations thereof In some embodiments, the fuel regulator valve 101 can receive a first fuel or a second fuel. In some embodiments, the first fuel may be liquid propane gas (LP) and the second fuel may be natural gas (NG). In FIG. 1, the heater assembly 100 includes a fuel source connection 115 and a fuel source connection 120. The heater assembly 100 can receive LP at fuel source connection 115. The heater assembly 100 can receive NG at fuel source connection 120.

In some embodiments, the heater assembly 100 can include a control valve 102. The control valve can include at least one of a manual valve, a thermostat valve, an AC solenoid, a DC solenoid and a flame adjustment motor. In the illustrated embodiment, the control valve 102 includes solenoids 125, 130. Solenoid 125 can be a safety valve that provides two-position, on/off control of fuel fluid flow within the heater assembly 100. Solenoid 130 can provide modulating control of the fuel fluid flow by varying the fuel fluid flow through the heater assembly 100. Alternatively, solenoid 130 can permit a high fluid flow rate or a low fluid flow rate through the heater assembly 100.

The heater assembly 100 can also direct fuel to an oxygen depletion sensor (ODS) 107. In some embodiments, the control valve 102 can control flow to oxygen depletion sensor (ODS) lines 116 and 117. As seen in FIG. 1, heating assembly 100 can include ODS line outlets 135 and 140. In FIG. 1, the heating assembly 100 is coupled to ODS line 116 at ODS line outlet 135, from which LP is supplied. Also, the heating assembly 100 is coupled to ODS line 117 at ODS line outlet 140, from which NG is supplied. The ODS lines 116, 117 are then coupled to the ODS 107.

In some embodiments, the ODS 107 comprises a thermocouple 121, which can be coupled to the control valve 102, and an igniter line 118, which can be coupled with an igniter 108. In some embodiments, the ODS 107 can be mounted to the main burner 106.

As also shown in FIG. 1, in some embodiments the heater can be a hybrid heating apparatus and can include an electric heating element 105. The electric heating element 105 and heater can be similar to that described in U.S. patent application Ser. No. 13/310,649 filed Dec. 2, 2011 and published as U.S. 2012/0145693, the entire contents of which are incorporated by reference herein and are to be considered a part of the specification.

In some embodiments, the heater can include a control board 103 that can receive signals from a remote control 104. It will be understood that some embodiments do not use a remote control and may not use a control board. In the pictured embodiment of FIGS. 1 and 2, the control board 103 is in communication with the solenoids 125, 130 of the control valve 102, the ODS 107, the igniter 108, and the receiver 109. This can allow a user to start the heater and to control the temperature of the heater among other features.

In the pictured embodiment of FIGS. 1 and 2, the receiver 109 receives signals from the remote control 104. In some embodiments, the control board 103 can receive inputs from devices directly, instead of or in addition to, through the receiver 109. In some embodiments, the receiver 109 receives inputs from other devices, such as a computer, phone, PDA, tablet, and/or other computing device. In some embodiments, the control board receives an input from an igniter switch 119, an on/off button, a user interface, etc.

In some embodiments, solenoids 125, 130 are also wired to the control board 103, as shown in FIG. 1. The control board 103 can send an output signal to solenoid 125 for two-position on/off control. The control board can also send an output signal to solenoid 130 to provide modulating control. For example, the control board 103 can stop fuel fluid flow within control valve 102 by sending an "off" signal to the solenoid 125. Alternatively, the control board 103 can vary the fuel fluid flow within control valve 102 by sending a modulating signal to solenoid 130. Furthermore, control board 103 can set a high fuel fluid flow rate or low fuel fluid flow rate within control valve 102 by sending a corresponding signal to solenoid 130. The control board 103 can determine what outputs to send to the solenoids 125, 130 based on the inputs received by the control board 103 and/or other data at the control board 103.

In some embodiments, thermocouple 121 is wired to the control board 103. This allows the control board 103 to use the temperature information received from the thermocouple 121. Other types of temperature sensors may be used with or in addition to the thermocouple. For example, the temperature sensor can be a thermister, a thermal fuse, or a resistance temperature detector (RTD).

In some embodiments, control board 103 is wired to a receiver 109. In some embodiments, the receiver 109 receives signals from a remote control 104. In some embodiments, the receiver 109 provides the received signals to the control board 103. For example, inputs entered into a remote control 104 are transmitted to the receiver 109. The receiver 109 then transmits these inputs to the control board 103 through a wired connection. In some embodiments, the receiver 109 sends the inputs to the control board 103 wirelessly. In some embodiments, the receiver 109 receives inputs from the remote control 104 wirelessly.

In some embodiments, the control signals received or sent by control board 103 are electronic. Many types of electronic control signals are possible. For example, the control signals received or sent by control board 103 may be a voltage, current, or a resistance signal. A voltage control signal may have a range of between 0 and 10 VDC, or 0 and 5 VDC, or some other range. A current control signal may have a range of between 4 and 20 mA, or 0 and 20 mA, or some other range. In some embodiments, the resistance signal is 1000 ohms, 100 ohms, or some other value or range. In some embodiments, the control signals received or sent by the control board 103 are wireless. In some embodiments, the control signals sent or received by the control board 103 are pneumatic.

In some embodiments, the control board 103 comprises a processor, battery, and/or memory. The battery provides power to the control board and its components. The memory stores instructions and/or data. The processor can determine what outputs the control board 103 should send based on the received inputs, stored data, and/or stored instructions. The processor can then execute instructions for the control board 103 to send outputs.

Figure 3:
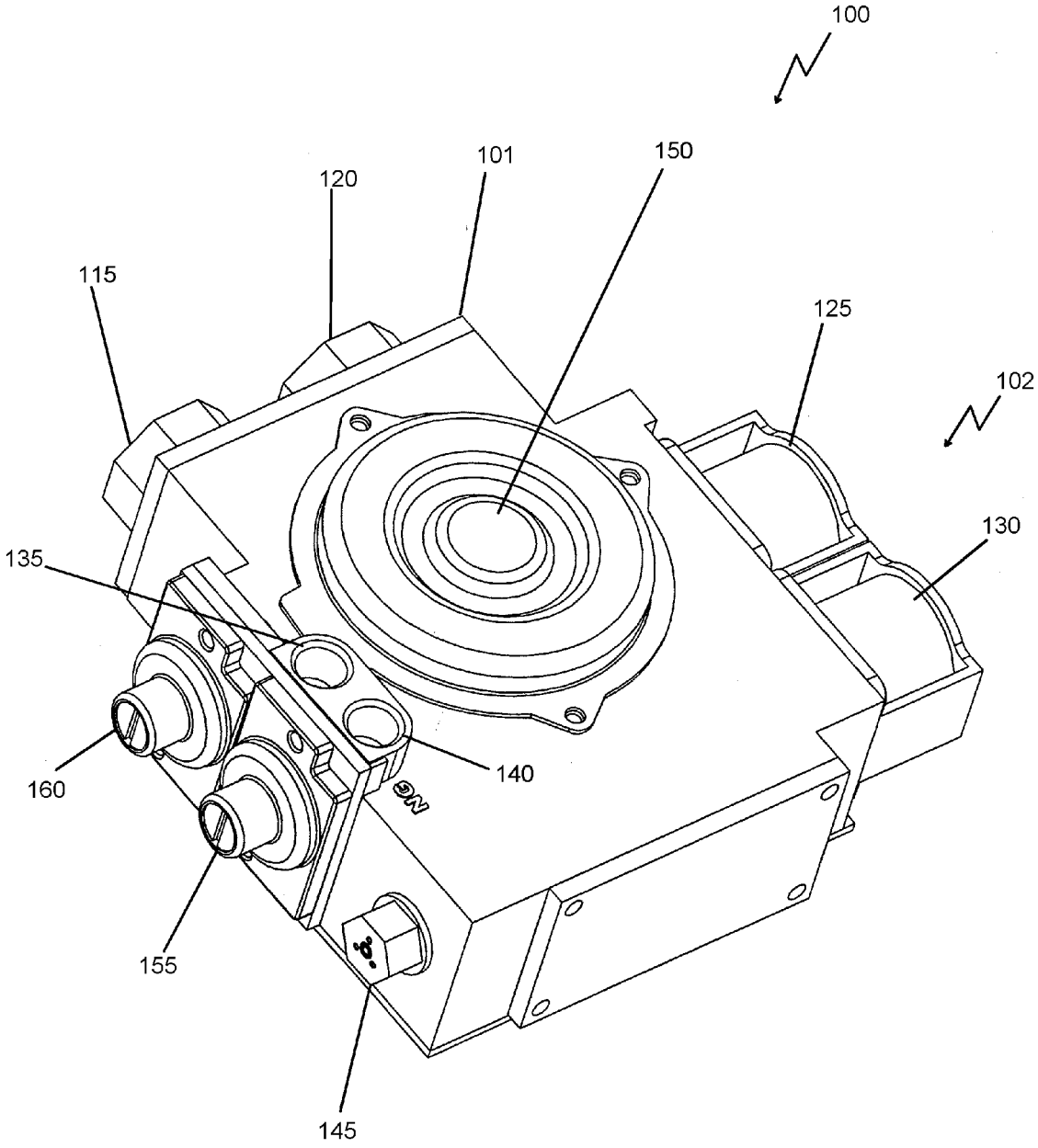
FIGS. 3 through 5 are perspective views of one embodiment of a fuel control device.
Figure 4:
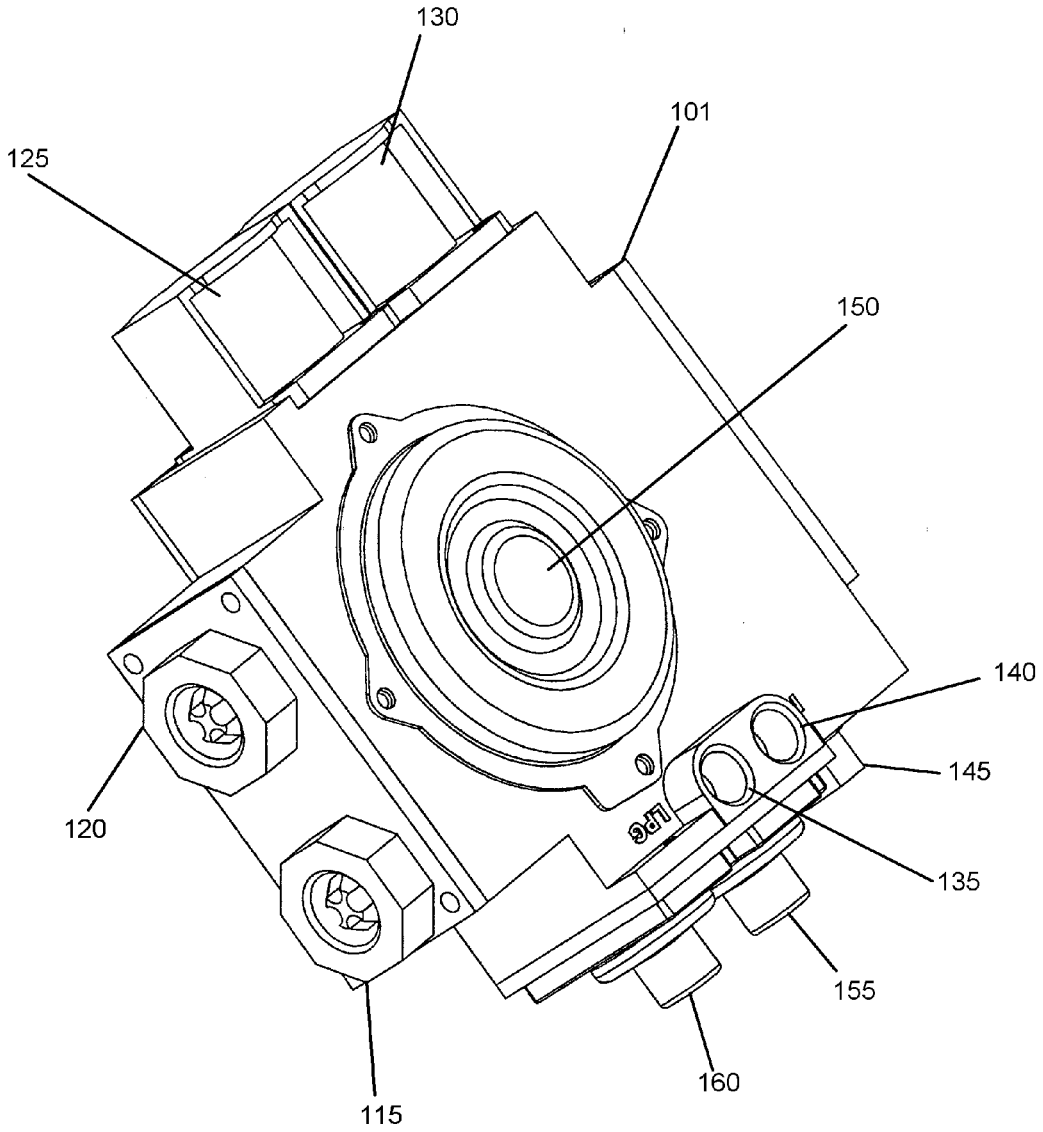
Figure 5:
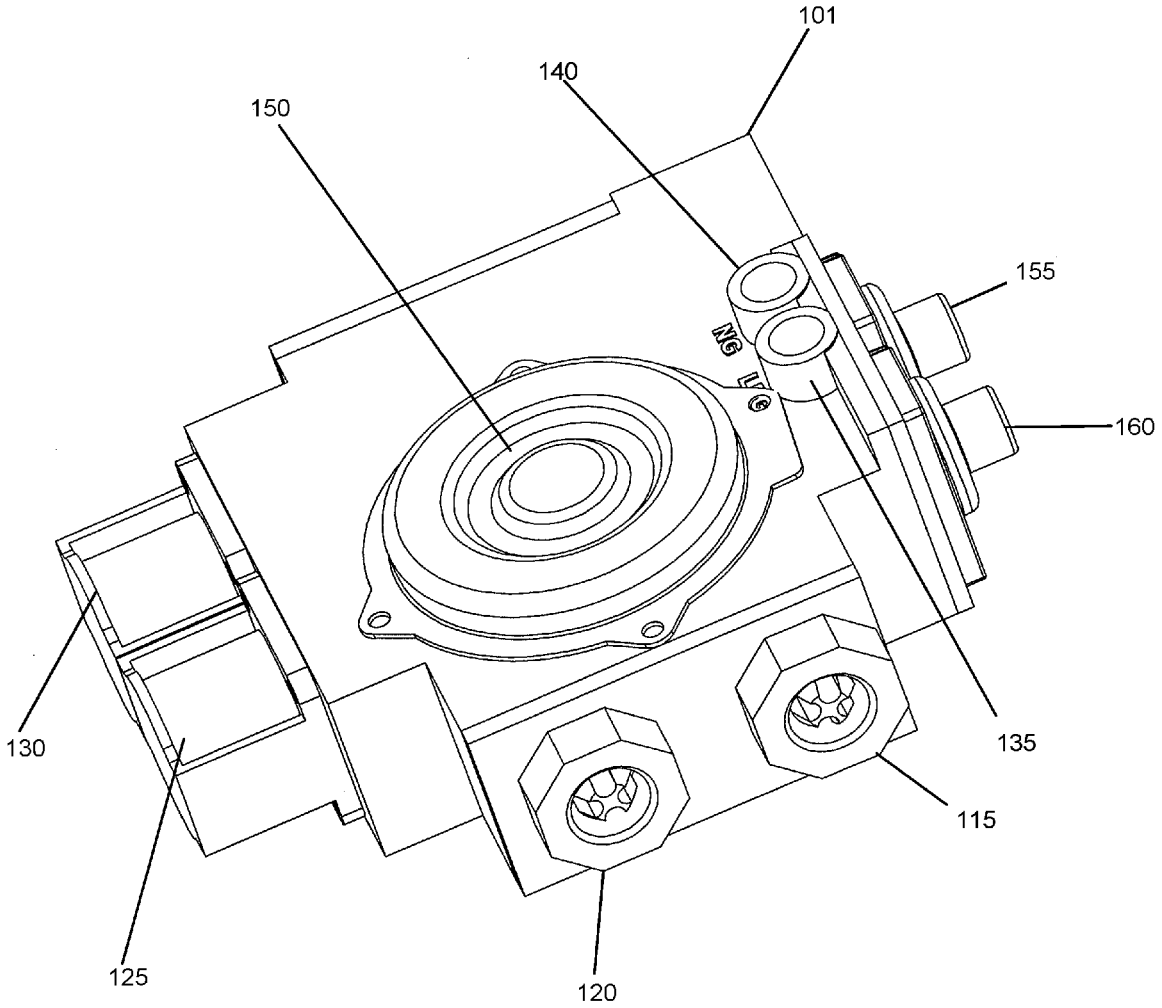

Turning now to FIGS. 3-5, the heating assembly 100 from FIG. 1 can be seen in detail. As shown, the heating assembly 100can include a first fuel source connection 115, a second fuel source connection 120, a control valve 102 with solenoids 125, 130, a first ODS outlet 135, a second ODS outlet 140, a burner nozzle 145, and a fuel regulator valve 101. The fuel regulator valve 101 can include a main pressure regulator 150, as well as, a first auxiliary pressure regulator 155, and a second auxiliary pressure regulator 160. In some embodiments, the fuel regulator valve 101 only one or no auxiliary pressure regulators. In some embodiments, the fuel regulator valve 101 includes three or more auxiliary pressure regulators. In some embodiments, the fuel regulator valve 101 includes two main pressure regulators, one for each different fuel type where the heater is a dual fuel heater.

Among other features, the heating assembly 100 can be used to select between two different fuels and to set certain parameters, such as one or more flowpaths, and/or a setting on one or more pressure regulators based on the desired and selected fuel. The heating assembly 100 can have a first mode configured to direct a flow of a first fuel (such as LP) in a first path through the heating assembly 100 and a second mode configured to direct a flow of a second fuel (such as NG) in a second path through the heating assembly 100.

The heating assembly 100 can connect to one of two different fuel sources, each fuel source having a different type of fuel therein configured to run at a different pressure. For example, one fuel source can be a cylinder of LP and another fuel source can be an NG fuel line in a house, connected to a city gas line. Fuel source connections 115 and 120 can comprise any type of connection such as a threaded connection, a locking connection, an advance and twist type connection, etc.

In the pictured embodiment of FIGS. 3-5, inserting a fitting into either fuel source connection 115 or 120 can automatically set a flowpath within the heating assembly 100. For example, if LP is supplied to the heating assembly 100, a flowpath is automatically set within the heating assembly 100 once the fitting is inserted into fuel source connection 115. Alternatively, if natural gas fuel is selected, a fitting is inserted into fuel source connection 120, which then automatically sets a fuel flowpath within the heating assembly 100. The selected flowpath can determine which pressure regulators are used (150, 155, 160), which ODS outlets are used (135, 140), and the operation of the burner nozzle 145. In other embodiments, selected flowpaths may affect different parts of the heating assembly 100. In other embodiments, a flowpath may be set by a switch, button, sensor, and/or some other input.

Figure 6:
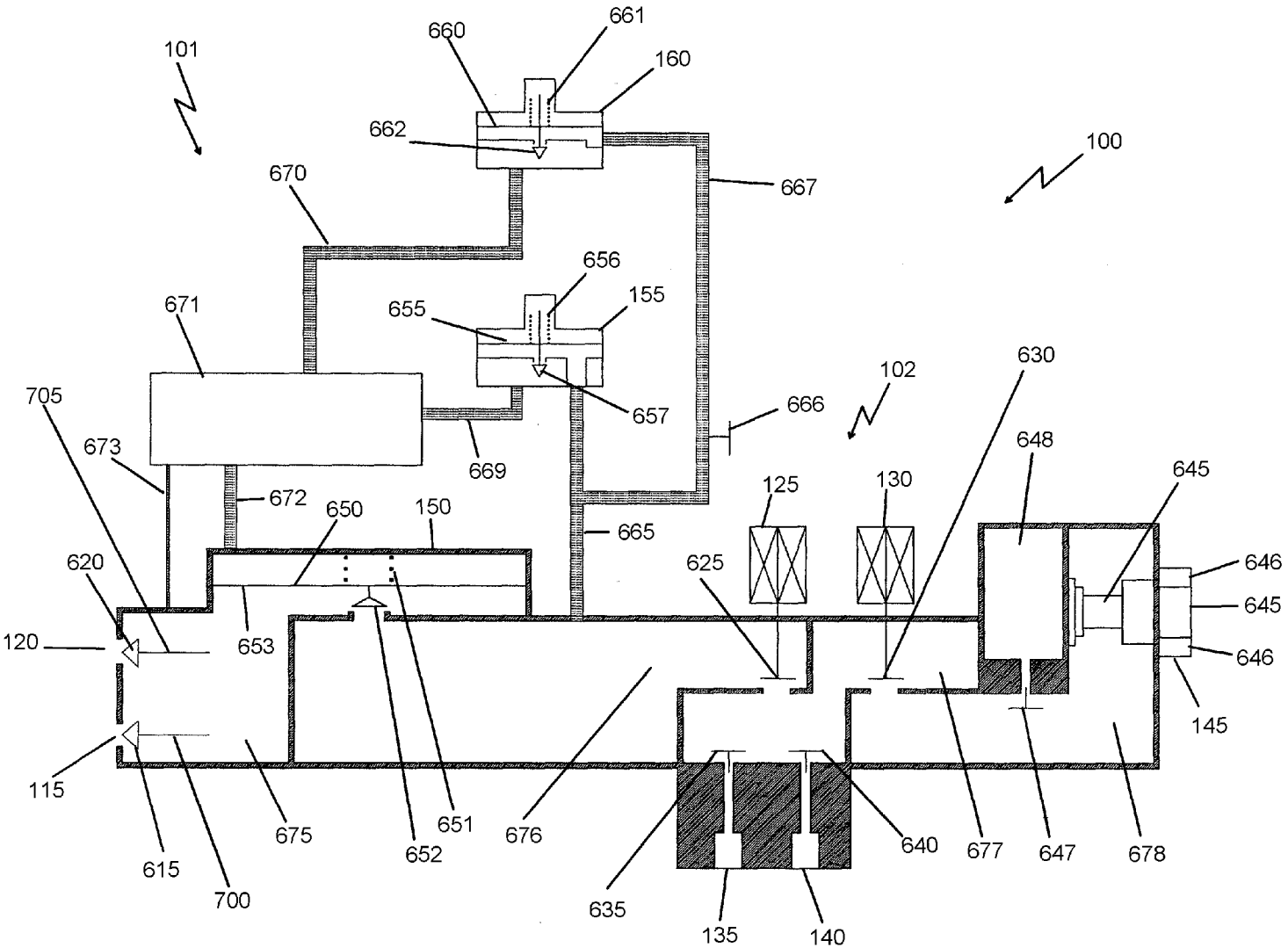
FIG. 6 is a schematic representation of one embodiment of a heater assembly.

Looking to FIG. 6, the schematic shows an embodiment of the heating assembly 100 and the flowpaths for the fuel within the heating assembly. One or more actuation members 700, 705 can be positioned at or in the first and second fuel source connections 115, 120. The one or more actuation members can be used to select, determine, or at least partially determine, the flowpath through the heating assembly. The actuation member can be operatively coupled to one or more valves, whose position can permit or prevent fluid flow. Moving the actuation member can open or close certain of these valves.

For example, as shown in FIG. 6, the first and second fuel source connections 115 and 120 each have a corresponding fuel source connection valve 615 and 620 positioned therein. The fuel source connection valves 615 in 620 can prevent fuel from exiting the heating assembly 100 undesirably, as well as preventing other undesirable materials from entering the heating assembly 100. In some embodiments, the heating assembly 100 can utilize a cap or plug to block the unused fuel source connection. This may be in addition to or instead of one or more valves at the fuel source connections. Though two actuation members are shown connected to the fuel source connection valves 615, 620, it will be understood that a single actuation member could also be used. The single actuation member could have one or two valves positioned at the fuel source connections. For example, the actuation member could have an initial open position at one fuel source connection and an initial closed position at the other fuel source connection. Connecting a fuel source fitting to the initially closed fuel source connection could open that fuel source connection and close the other.

The one or more actuation members can also be used to control flow to other parts of the heating assembly in addition to, or instead of the fuel source connections. For example, the one or more actuation members can be operably coupled to one or more valves controlling fluid flow to one or more ODS outlets 135, 140, to the burner nozzle 145, to the control valve 102, to the pressure regulator 150, to the fuel regulator valve 101, and to components outside of the heating assembly which may include any of the before mentioned and other components. The actuation member can also be operatively coupled to other components such as an air shutter.

In the illustrated embodiment, the actuation members 700, 705 can be connected to one or more of the valves 615, 620, 666, 635, 640, and 647, as will be described in more detail below. In FIG. 6, both fuel source connection valves 615 and 620 are shown in the open position. This schematically illustrates the position of the fuel source connection valves as would be seen after inserting a fitting into the fuel source connections 115, 120.

Figure 9:
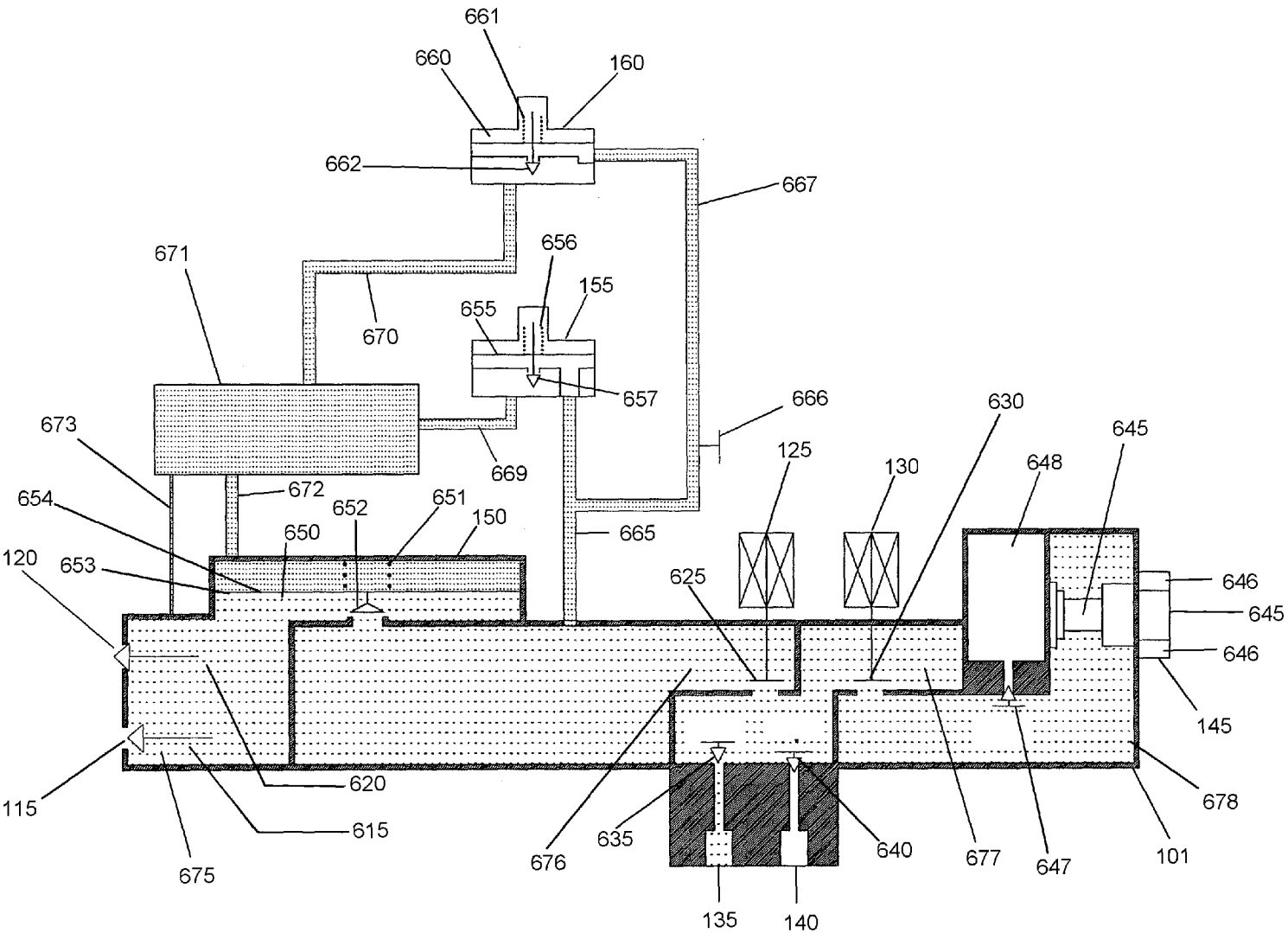
FIG. 9 is a schematic view of the heater assembly in a first position.
Figure 11:
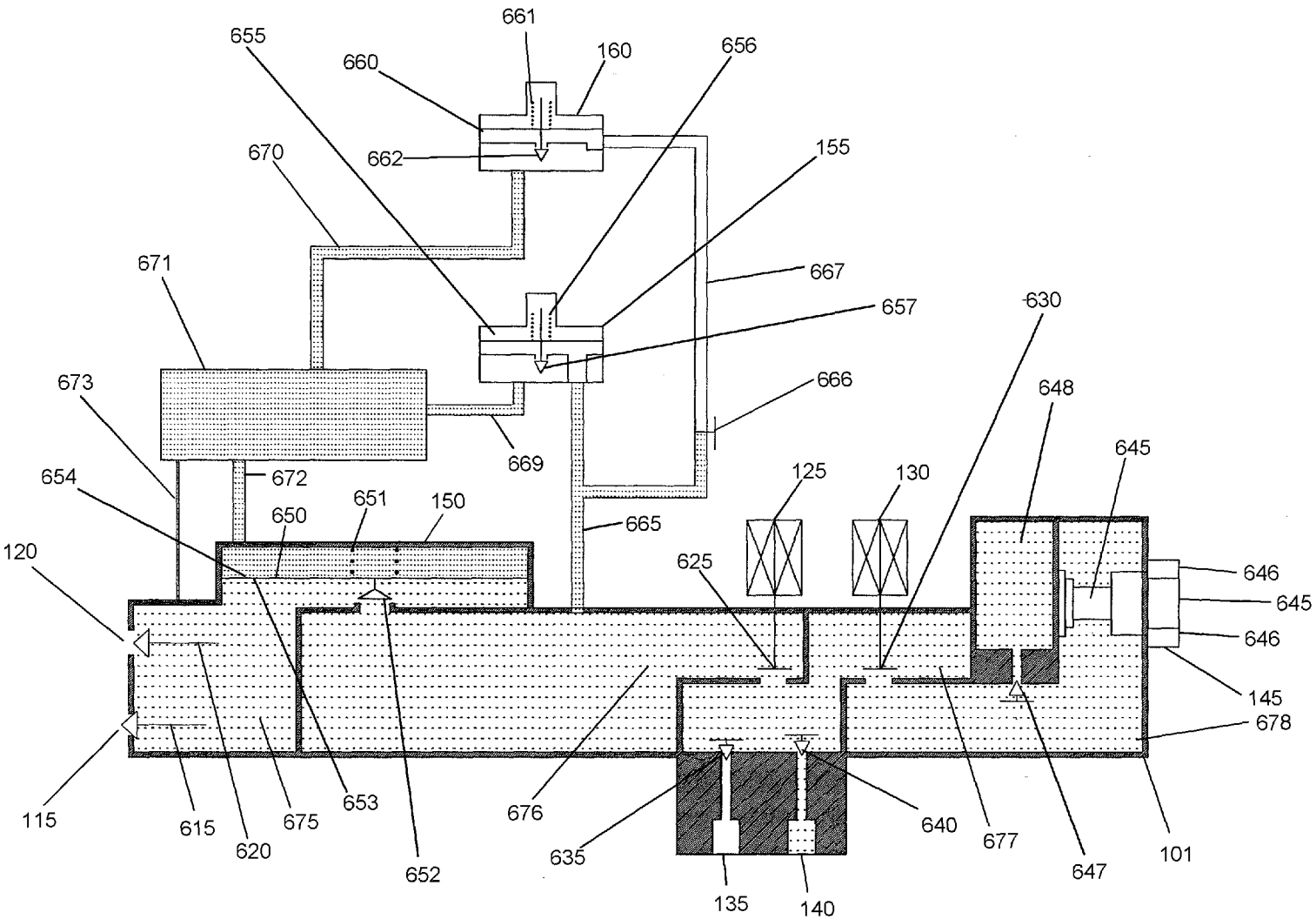
FIG. 11 is a schematic view of one embodiment of the heater assembly in a second position

FIGS. 9 and 11 show the heating assembly 100 in two different modes. In FIG. 9, fuel source connection valve 615 is open and fuel source connection valve 620 is closed. In this case, the fitting has been inserted into fuel source connection 115. In the displayed embodiment of FIG. 9, the selected fuel is liquid propane. In FIG. 11, fuel source connection valve 615 is closed and fuel source connection valve 620 is open. Here, the fitting has been inserted into fuel source connection 120. In the displayed embodiment of FIG. 11, the selected fuel is natural gas. FIGS. 9 and 11 will be discussed in more detail below.

Fuel Regulator Valve

In the displayed embodiment of FIGS. 6, 9, and 11, inserting a fitting into a fuel source connection may also determine how fluid can flow through the fuel regulator valve 101. The fuel regulator valve 101 can include one or more pressure regulators which pressure regulators are used to deliver the fuel at a predetermined selected pressure or within a selected pressure range. As has been mentioned, when the heating assembly is used with a dual fuel heater, the heater assembly can be user selectable for use with one of two different fuel types. For example, the heater assembly can be configured to work with either natural gas or liquid propane. Because these fuels are generally provided at different pressures, the fuel regulator valve can be used to regulate the pressure of the fuel flow within a set range. This can allow, for example, for the heater to then be configured, based on those fuels within those pressure ranges, to produce similar BTU ratings independent of the fuel used.

For example, the predetermined pressure range for natural gas can be set to be within the range of about 3 inches of water column to about 6 inches of water column and the predetermined pressure range for liquid propane can be set to be within the range of about 8 inches of water column to about 12 inches of water column.

The pressure regulator's 150, 155, and 160 can function in a similar manner to that discussed in U.S. application Ser. No. 11/443,484, filed May 30, 2006, now U.S. Pat. No. 7,607,426, incorporated herein by reference and made a part of this specification; with particular reference to the discussion on pressure regulators at columns 3-9 and FIGS. 3-7 of the issued patent.

The main pressure regulator 150 can be the primary source to regulate the pressure of the fuel to be delivered. One or more auxiliary pressure regulators can be used to adjust the pressure and the pressure range of the main pressure regulator 150. Each of the pressure regulators can have a spring loaded valve connected to a diaphragm. The fluid pressure acting on the diaphragm can move the valve allowing more or less fluid to flow through the pressure regulator depending on the orientation of the valve with respect to a valve seat which are generally positioned within the flow passage through the pressure regulator.

In some embodiments, the main pressure regulator 150 can be configured to regulate a first fuel within a set pressure range. When a second fuel is to be used within a different pressure range the main pressure regulator 150 would need to be adjusted. One way that this can be done is by rotating a screw connected to the spring to adjust the spring force required to move the diaphragm. Alternatively, in some embodiments one or more auxiliary pressure regulators can be used to adjust the pressure and the pressure range of the main pressure regulator 150.

For example, an auxiliary pressure regulator 155 can be used to bleed off some of the fluid flow to provide a back pressure on the back side 654 of the diaphragm 650 of the main pressure regulator 150. The back pressure can require that fluid at a higher pressure act on the front side 653 of the diaphragm 650 in order to move the diaphragm and therefore the spring 651 and valve 652. This can therefore change the pressure range of the main pressure regulator based on the settings of the auxiliary pressure regulator 155. Thus, the auxiliary pressure regulator 155 can be used to determine the amount of fluid that flow to the back of the diaphragm to determine the amount of back pressure.

Looking now to FIGS. 6, 9, and 11 another embodiment of the fuel regulator valve 101 will be described. When a fitting is connected to a fuel source connection, the fuel flows through the fuel source connection into the fuel source connection chamber 675. Next, the fuel comes into contact with the main pressure regulator 150 at the main pressure regulator diaphragm. The main pressure regulator diaphragm has a front side 653 and a back side 654. The fuel comes into contact with the front side 653 first. The fuel then leaves the main pressure regulator 150 and may enter the solenoid chamber 676, as long as the main pressure regulator valve 652 is open. If the main pressure regulator valve 652 moves more towards a closed position, then the amount of the fuel exiting the main pressure regulator 150 decrease. Alternatively, if the main pressure regulator valve 652 moves more towards an open position, the amount of discharged fuel from the main pressure regulator increases. The valve 652 position changes depending on the amount of fluid coming into contact with the main pressure regulator diaphragm back side 654. Other configurations for the main pressure regulator 150 to alter the fuel pressure are possible.

The back side 654 of the diaphragm of the main pressure regulator 150 can receive fluid directly from the one or more auxiliary pressure regulator and/or from a main pressure regulator chamber 671. Fluid from the main pressure regulator chamber 671 travels along the main pressure regulator flowpath 672 into the main pressure regulator 150. This fluid comes in the contact with the main pressure regulator diaphragm 650 at the main pressure regulator diaphragm back side 654. As the volume and/or pressure of the fluid in contact with the main pressure regulator diaphragm backside 654 increases, the main pressure regulator valve 652 moves further closed. The volume and/or pressure of the fluid in contact with the main pressure regulator diaphragm backside 654 can be increased by using one or more auxiliary pressure regulators. If used, the auxiliary pressure regulators provide additional fluid to the main pressure regulator chamber 671, which in turns makes its way to the main pressure regulator diaphragm backside 654. Other configurations for the main pressure regulator 150 to alter the fuel pressure are possible.

By using one or more auxiliary pressure regulators, a backline pressure can be introduced to the main pressure regulator. The backline pressure help regulate the fuel pressure of the discharged fuel from the main pressure regulator 150. As a result, the main pressure regulator 150 can provide one or more predetermined fuel pressures by using one or more auxiliary pressure regulators.

The main pressure regulator 150, first auxiliary pressure regulator 155, and second auxiliary pressure regulator 160 can be set depending on whether a fitting is inserted into one of the fuel source connections. Inserting a fitting into fuel source connection 120 can set an initial predetermined pressure or pressure range that is lower than a second predetermined pressure or pressure range. By altering the predetermined selected pressure based on the fuel, the selected pressure may desirably provide for safe and efficient fuel combustion and reduce, mitigate, or minimize undesirable emissions and pollution.

For example, in FIG. 11 a fitting is inserted into fuel source connection 120. The supplied fuel can be natural gas, as one example. The flowpath is now set such that the main pressure regulator 150 and the first auxiliary pressure regulator 155 can be used. In some embodiments, the predetermined pressure for natural gas can be set to be within the range of about 3 inches of water column to about 6 inches of water column, including all values and sub-ranges therebetween. The second auxiliary pressure regulator 160 will not be used because the valve 666 is shut. Thus, the auxiliary pressure regulator flowpath 665 can provide fuel to the first auxiliary pressure regulator 155 but not to the second auxiliary pressure regulator 160.

In FIG. 9, a fitting is inserted into fuel source connection 115. The supplied fuel can be liquid propane, as one example. The flowpath is now set to use the main pressure regulator 150, the first auxiliary pressure regulator 155, and the second auxiliary pressure regulator 160. This can be because the valve 666 can be connected to the actuation member 700. In some embodiments, the predetermined pressure for liquid propane can be set to be within the range of about 8 inches of water column to about 12 inches of water column, including all values and sub-ranges therebetween.

In some embodiments, when liquid propane is the fuel to be supplied to fuel source connection 115 and natural gas is the fuel to be supplied to fuel source connection 120, the predetermined pressure for liquid propane should be higher than the predetermined pressure for natural gas. In other embodiments, the fuel regulator valve 101 can be configured to use different fuel fluids. In other embodiments in which different fuel fluids are to be supplied, the pressure ranges may be higher or lower than those in the current embodiment, depending on the types of fuel to be provided and the typical pressures used with those fuels.

In FIG. 9, the second auxiliary pressure regulator flowpath valve 666 is open. As a result, a portion of the fuel enters the second auxiliary pressure regulator flowpath 667. From here, the fuel enters the second auxiliary pressure regulator 160, which comprises a diaphragm 660, a spring 661, and a valve 662. The fuel is then discharge from the second auxiliary pressure regulator 160 into the second auxiliary pressure regulator main pressure regulator chamber flowpath 670. From here, the fuel enters the main pressure regulator chamber 671.

The first auxiliary pressure regulator 155 includes a diaphragm 655, a spring 656, and a valve 657. The fuel is discharged from the first auxiliary pressure regulator 155 into the first auxiliary pressure regulator main pressure regulator flowpath 669. From here, the fuel enters the main pressure regulator chamber 671. The fuel in the main pressure regulator chamber 671 reaches the main pressure regulator 150 by traveling along the main pressure regulator flowpath 672. Also, a portion of the fuel in fuel source connection chamber 675 may enter the main pressure regulator chamber 671 by traveling along the main pressure regulator chamber flowpath 673. Other configurations of the flowpaths to the main and auxiliary pressure regulators are possible.

In the current embodiment, the first and second auxiliary pressure regulators have a shared auxiliary pressure regulator flowpath 665. In some embodiments, each auxiliary pressure regulator has its own dedicated auxiliary pressure regulator flowpath. In some embodiments, more than two auxiliary pressure regulators are included, thus requiring more than two auxiliary pressure regulator flowpaths. In some embodiments, each auxiliary pressure regulator flowpath has an auxiliary pressure regulator flowpath valve.

In some embodiments, flowpaths are within the housing of the heating assembly 100. In some embodiments, flowpaths are pipes, tubes, and/or lines. In some embodiments, the auxiliary pressure regulators and/or the main pressure regulator chamber 671 are not located within the same fuel regulator valve 101. In some embodiments, the main pressure regulator 150 is not located within the fuel regulator valve 101.

In some embodiments, the pressure regulators comprise more components than a spring, a diaphragm, and valve. In some embodiments, the pressure regulators use different components from a spring, diaphragm, and/or valve. In some embodiments, the default position of the auxiliary pressure regulator flowpath valve 666 is closed, open, and/or the valve's last position.

Control Valve

Continuing with reference to FIGS. 6, 9, and 11, flow from the fuel regulator valve 101 can be directed to the control valve 101. In the pictured embodiments of FIGS. 6, 9, and 11, solenoid valves 125 and 130 are used to control the flow of fuel. As a first step, the position of the solenoid valve 625 can be controlled by solenoid 125 to determine whether fluid can flow to the ODS, burner nozzle and ultimately the burner. In order for fluid to flow from solenoid chamber 676 through the control valve 101, solenoid 125 may control solenoid valve 625 to remain open. Alternatively, the control valve can be controlled to be "off" by closing the solenoid valve 625.

When the solenoid valve 625 is open, a portion of the fuel can flow through to the ODS lines 135 and 140 as long as their corresponding ODS line valves, 635 and 640, are open. In FIG. 9, ODS line valve 635 is open and ODS line valve 640 is closed, while in FIG. 11, ODS line valve 640 is open and ODS line valve 635 is closed. These valves can also be connected to the respective actuation members depending on the type of fuel to be used.

The remaining portion of the fuel can flow to the solenoid chamber 677. The solenoid valve 630 can be modulated by the solenoid 130 to permit a variable fuel flow rate, a low fuel flow rate, or a high fuel flow rate. The solenoid valve 630 is able to provide modulated control of the fuel flow.

In the pictured embodiments of FIGS. 6, 9, and 11, if the solenoid valve 630 is open, the fuel flows from the solenoid chamber 677 to the nozzle outer chamber 678. The burner nozzle 145 can include one or more center orifices 645 and one or more outer orifices 646. The outer orifices 646 can include a plurality of orifices that surround the center orifice (s) 645. The outer orifice 646 is in fluid communication with the main outer chamber 678. The center orifice 645 is in fluid communication with the center chamber 648. The center nozzle valve 647 can open to permit fuel to enter the center chamber 648 from the outer chamber 678. The center nozzle valve 647 can be operatively connected to second fuel source connection 120 and/or the second fuel source valve 620, such as through an actuation member 705.

In FIG. 9, because the fitting is inserted into fuel source connection 115, the center valve 647 is closed. As a result, the fuel flowing in from the solenoid chamber 677 into the outer chamber 678 can flow out of the outer orifice(s) 646. None of the fuel enters the center chamber 648 because the center valve 647 is closed.

Alternatively, in FIG. 11 the fitting is inserted into fuel source connection 120. As a result, the center valve 647 is open. This permits a portion of the fuel to flow from the outer chamber 678 into the center chamber 648. From here, the fuel can flow out of the center orifice(s) 645. A portion of the fuel in outer chamber 678 can also flow out of the outer orifice(s) 646.

Figure 7:
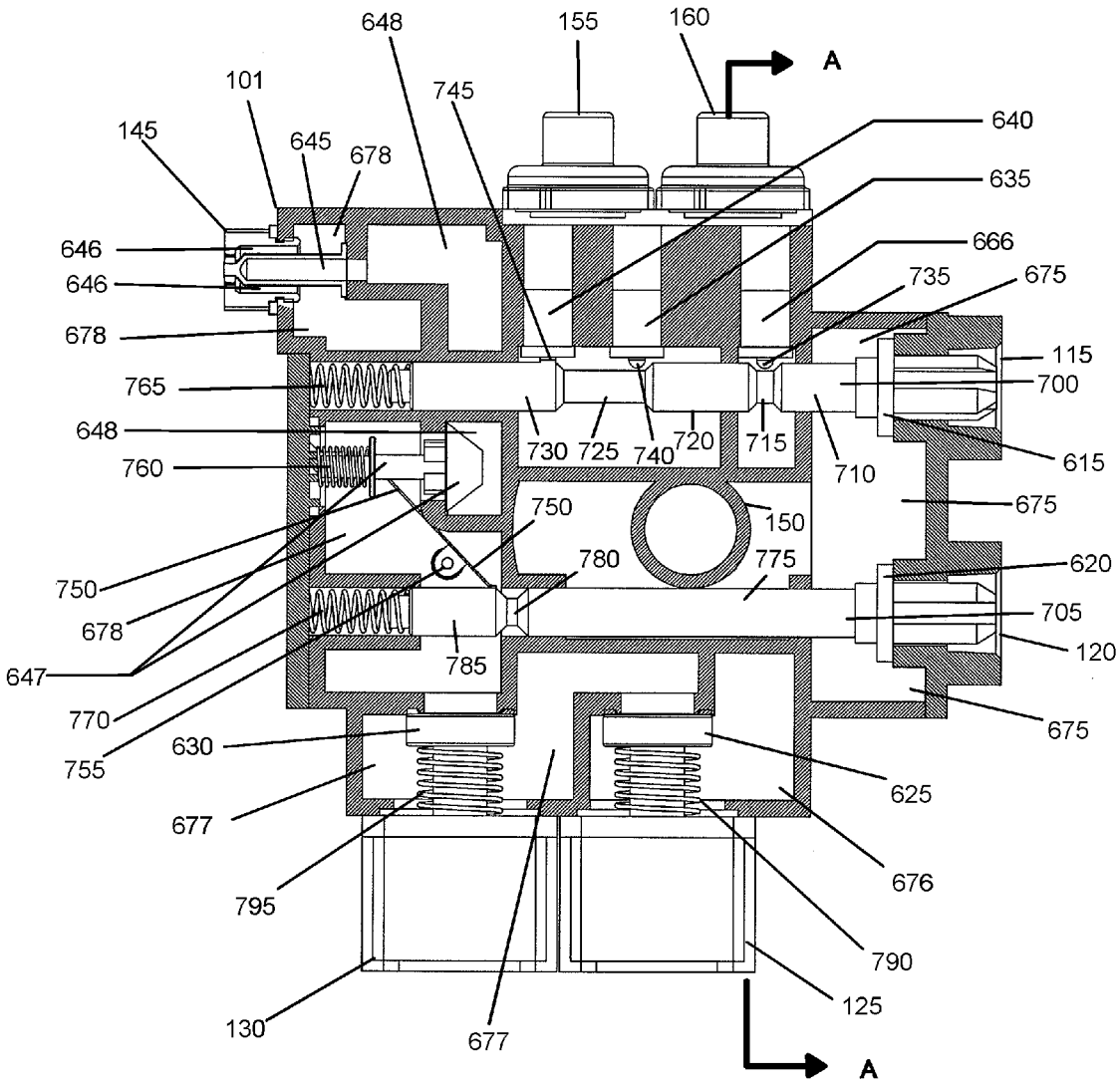
FIG. 7 is a cross-section of the heater assembly of FIGS. 3 through 5.
Figure 8:
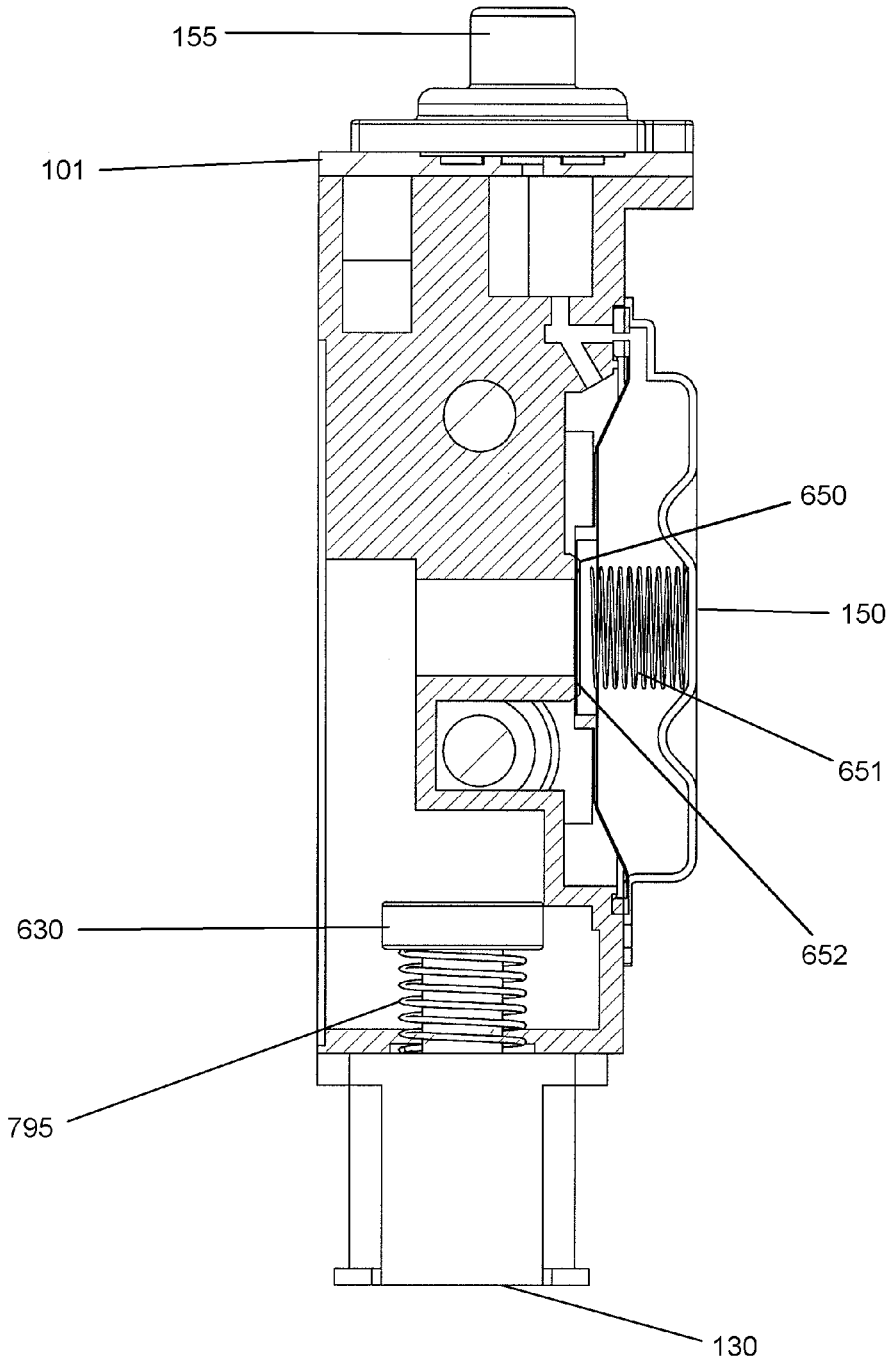
FIG. 8 is a cross-section of the heater assembly taken along line A-A of FIG. 7.

Turning now to FIGS. 7, 8, 10, and 12, an embodiment of a heating assembly 100 will be described showing the functioning of actuation members 700, 705. FIG. 7 displays a cross-section of the heating assembly 100. FIG. 8 shows a cross-section of the heating assembly 100 along line A-A of FIG. 7. The actuation members can be used to select one or more flowpaths through the heating assembly 100 and/or determine parameters of the heating assembly 100. The one or more actuation members can be provided in the heating assembly 100. As shown, the actuation members are spring loaded rods that can be advanced in a linear motion. In other embodiments, an actuation member can be one or more of a linkage, a rod, an electric or mechanical button, a pin, a slider, a gear, a cam, etc.

The first actuation member 700 includes a first section 710, a second section 715, a third section 720, a fourth section 725, and a fifth section 730. In the displayed embodiment, the first actuation member first section 710, third section 720, and fifth section 730 have a larger outside diameter than the first actuation member's second section 715 and fourth section 725. The first actuation member first section 710, third section 720, and fifth section 730 have the same larger outside diameter. The first actuation member second section 715 and fourth section 725 have the same narrower outside diameter.

The first actuation member fifth section engages with the first actuation member spring 765. The first actuation member also interacts with the second auxiliary pressure regulator flowpath connection 735 and ODS line connections 740 and 745 to thereby open or close valves 666, 635, 640 connected thereto.

Figure 12:
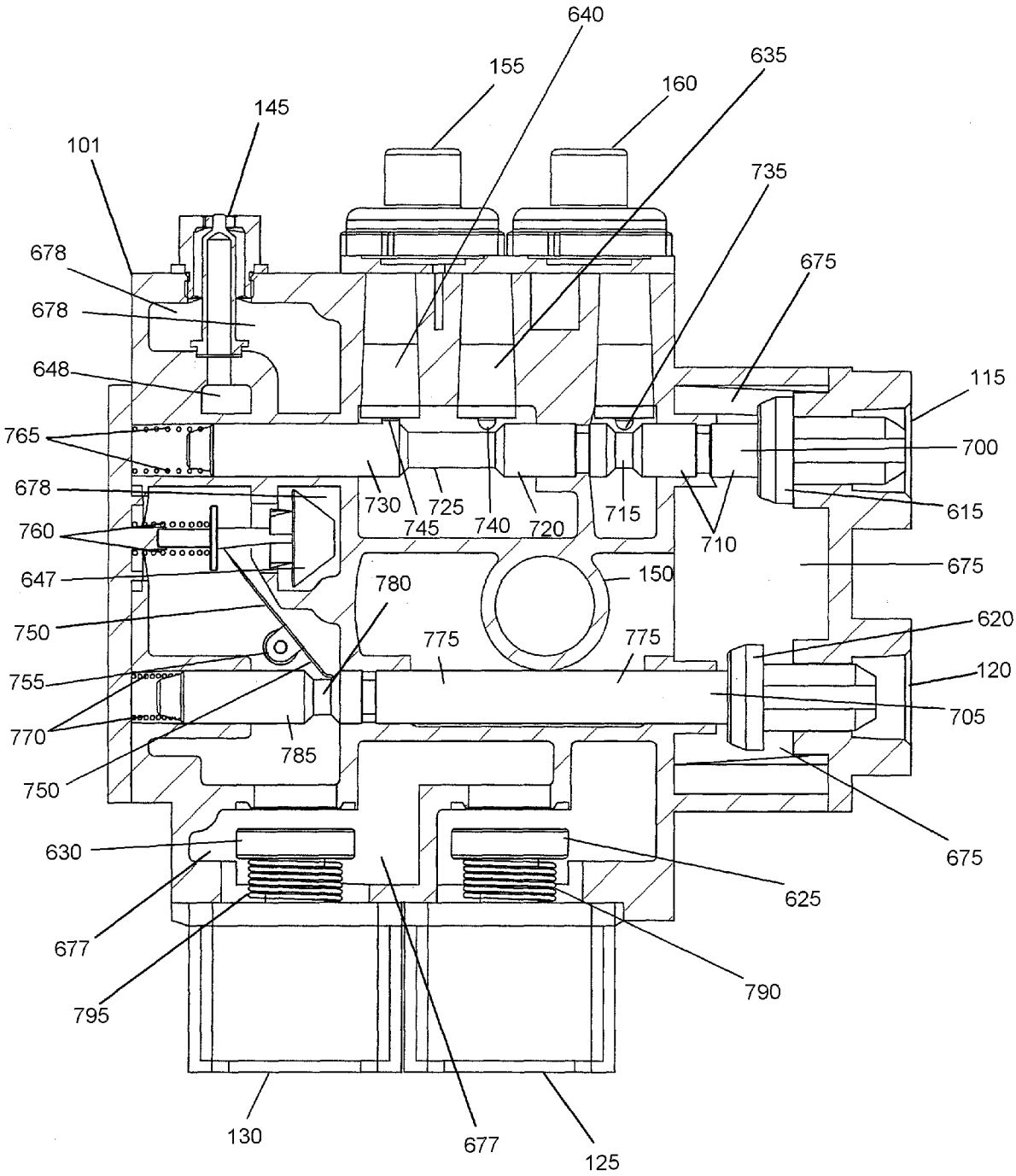
FIG. 12 is a cross-section of the heater assembly in a second position.

FIGS. 7 and 12 display the first actuation member 700 without a fitting inserted into fuel source connection 115. The first actuation member fifth section 730 is engaged with the ODS line connection 745. The first actuation member 700 is not engaged with the ODS line connection 740 or the second auxiliary pressure regulator flowpath connection 735. The second auxiliary pressure regulator flowpath connection 735 is located adjacent to the first actuation member second section 715, which has a narrower outside diameter. The ODS line connection 740 is adjacent to the first actuation member fourth section 725, which also has a narrower outside diameter. The first actuation member spring 765 is at rest.

Figure 10:
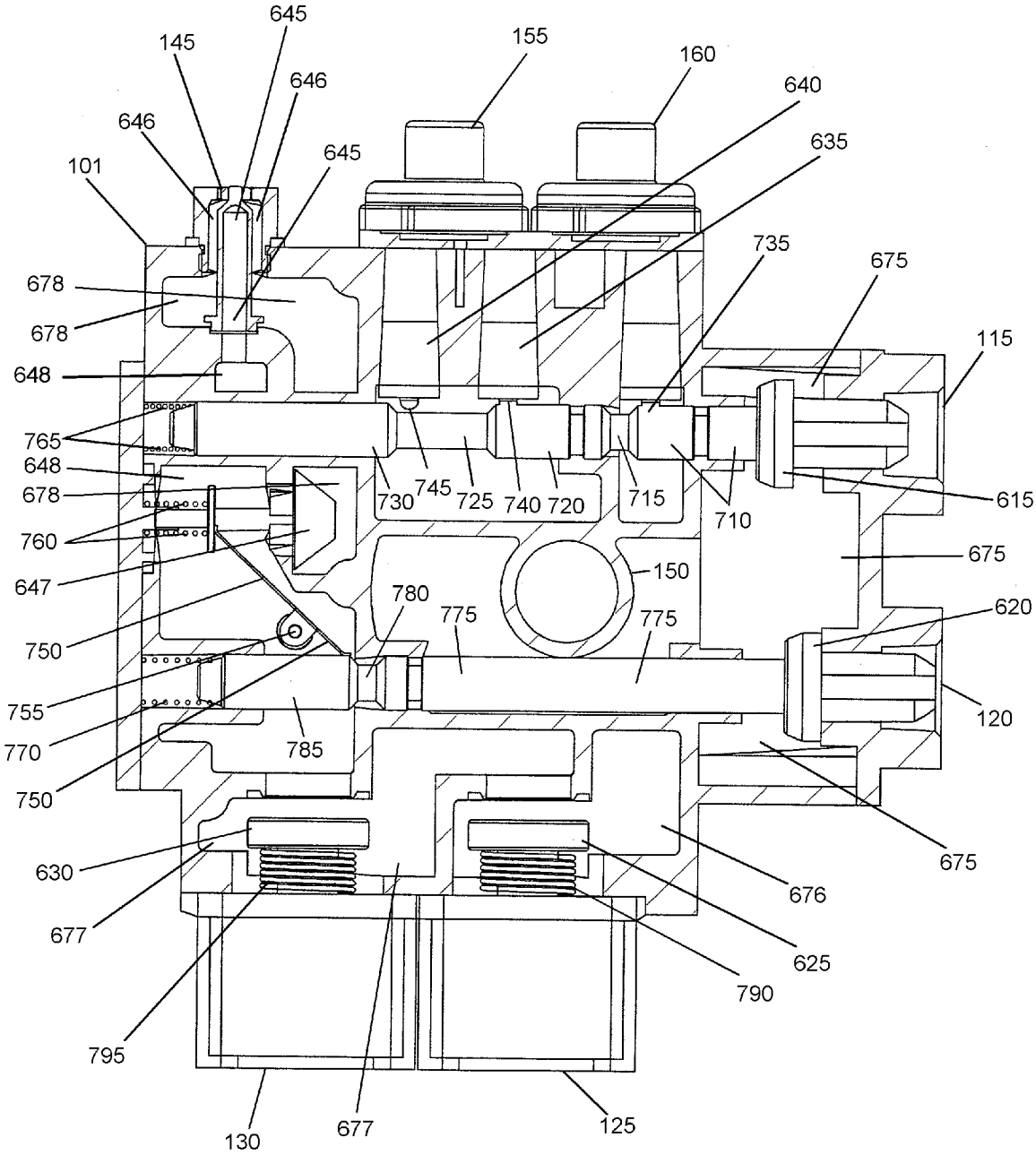
FIG. 10 is a cross-section of one embodiment of the heater assembly in a first position.

In FIG. 10, the first actuation member 700 is displayed as if a fitting is within the fuel source connection 115. By inserting the fitting into fuel source connection 115, the first actuation member 700 is linearly moved along its longitudinal axis and compresses the first actuation member spring 765 as a result of the motion. The first actuation member first section 710 is engaged with the second auxiliary pressure regulator flowpath connection 735. The first actuation member third section 720 is engaged with the ODS line connection 740. The first actuation member fifth section 730 is no longer engaged with the ODS line connection 745. Instead, the ODS line connection 745 is adjacent to the first actuation member fourth section 725, which has a narrower diameter. As shown, the first actuation member can allow a pressure regulator and ODS line flowpath to be determined based simply on whether or not a fitting is inserted into fuel source connection 115.

In some embodiments, the first actuation member 700 has more than five sections. In some embodiments, the first actuation member 700 has less than five sections. In some embodiments, the outside diameters of the wider sections, 710, 720, and 730, are not equal. In some embodiments, the outside diameters of the narrower sections, 715 and 720, are not equal. In some embodiments, the actuation member 700 can extend along a longitudinal axis and have a plurality of longitudinal cross-sections of different shapes. In some embodiments, the actuation member 700 can be a type of cam and can also be different shapes from cylindrical.

In the displayed embodiment of FIG. 10, with the fitting in the fuel source connection 115 the fuel source connection valve 615 is open and allows fluid to enter into fuel source connection chamber 675. In this position the first actuation member 700 also engages the second auxiliary pressure regulator flowpath connection 735 and the ODS line connection 740. The ODS line connection 745 is not engaged by the first actuation member 700. The first actuation member spring 765 is compressed and prevents the fitting from being inserted to far into fuel source connection 115. The fuel flows from the fuel source connection chamber 675 to the main pressure regulator 150, where it is then discharged.

From here, the fuel can then flow towards the second auxiliary pressure regulator flowpath valve 666 or the solenoid chamber 676. The portion of fuel that flows towards the second auxiliary pressure regulator flowpath valve 666 will then follow the auxiliary pressure regulator flowpath similar to that described earlier with respect to FIG. 9.

The fuel discharged from the main pressure regulator 150 can flow to the solenoid chamber 676. When the solenoid valve 625 is open, the solenoid valve spring 790 compresses and can prevents the solenoid valve 625 from opening too much. When the solenoid valve 625 is open, the fluid may then flow towards either the ODS line valve 635 or the solenoid chamber 677. The portion of the fluid that flows towards the ODS line valve 635 is eventually discharged at the ODS line outlet 135. The remaining fluid flows toward solenoid chamber 677.

When the solenoid valve 630 is open, the solenoid valve spring 795 compresses and prevents the solenoid valve 630 from opening too much. When the solenoid valve 630 is open, fluid can flow from solenoid chamber 677 to outer chamber 678. The fluid does not flow to the center chamber 648 because the center valve 647 is closed. Once at the outer chamber 678, the fluid can then flow through the outer orifice (s) 646. Other configurations of flowpaths for fuel provided to fuel source connection 115 are also possible.

FIGS. 7 and 10 display the second actuation member 705 without a fitting inserted into fuel source connection 120. The second actuation member 705 includes a second actuation member first section 775, a second actuation member second section 780, and a second actuation member third section 785. The second actuation member second section 780 has a narrower outside diameter than the first section 775 and the third section 785. The outside diameters of the first section 775 and the third section 785 are equal. The second actuation member 705 engages a second actuation member spring 770 and an arm 750.

The arm 750 engages the surface of the second actuation member third section 785 at one end, and the main burner center orifice valve 647 at the other end. In between the two ends, the arm 750 includes a pin 755 about which the arm 750 rotates. The pin 755 attaches the arm 750 to the heating assembly 100.

In FIG. 12, a second actuation member is shown as if a fitting is inserted into fuel source connection 120. As a result, the second actuation member 705 is linearly translated along the longitudinal axis of the second actuation member 705. As the member 705 moves, the arm 750 now engages the surface of the second actuation member second section 780. The second section 780 outside diameter is narrower than the third section 785. As a result, the arm 750 moves and is rotated about the pin 755. The arm rotation opens the center valve 647 and tensions the center valve spring 760. The second actuation member spring 770 is compressed by the second actuation member third section 785.

In some embodiments, the second actuation member 705 has more than three sections. In some embodiments, the second actuation member 705 has less than three sections. In some embodiments, the outside diameters of the wider sections, 775 and 785, are not equal. In some embodiments, the second actuation member 705 can extend along a longitudinal axis and have a plurality of longitudinal cross-sections of different shapes. In some embodiments, the second actuation member 705 can be a type of cam and can also be different shapes from cylindrical.

In some embodiments, the arm 750 is a flexible material that can be moved and bent between positions with a resiliency to return to an unbent or less bent position. In some embodiments, the arm can be a linkage, a pinned rotating arm, a member suspended between the actuation member and the valve, etc. The arm 750 can be elongate, have spring qualities, be biased upwards, be a bent metal arm or beam, etc.

In the displayed embodiment of FIG. 12, the fuel source connection valve 620 is open which allows fluid to enter into fuel source connection chamber 675. The second actuation member 705 has been moved to compress the second actuation member spring 770 and rotate the arm 750 about the pin 755. The rotation of the arm 750 causes the center valve 647 to open. The compressed second actuation member spring 770 can prevent the fitting from being inserted too far into the fuel source connection 120. The fuel can flow from the fuel source connection chamber 675 to the main pressure regulator 150, where it is then discharged.

From here, the fuel can then flow towards the first auxiliary pressure regulator 155 or the solenoid chamber 676. The portion of fuel that flows towards the first auxiliary pressure regulator 155 can then follow the first auxiliary pressure regulator flowpath similar to that described earlier with respect to FIG. 11.

Fuel discharged from the main pressure regulator 150 can flow to the solenoid chamber 676. When the solenoid valve 625 is open, the solenoid valve spring 790 compresses and can prevent the solenoid valve 625 from opening too much. When the solenoid valve 625 is open, the fluid may then flow towards either the ODS line valve 640 or the solenoid chamber 677. The portion of the fluid that flows towards the ODS line valve 640 is eventually discharged at the ODS line outlet 140. The remaining fluid can flow toward solenoid chamber 677.

When the solenoid valve 630 opens, the solenoid valve spring 795 compresses and can prevents the solenoid valve 630 from opening too much. When the solenoid valve 630 is open, the fluid can then flow from solenoid chamber 677 to either the main burner outer orifice chamber 678 or the center chamber 648. The fluid can flow to the center chamber 648 because the center valve 647 is opened by the rotated arm 750.

The portion of the fluid at the main burner outer orifice chamber 678 can exit the heating assembly 100 through the outer orifice(s) 646. The remaining fluid at the center chamber 648 can exit the heating assembly 100 through the main burner center orifice(s) 645. Other configurations of flowpaths for fuel provided to fuel source connection 120 are possible.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A heating assembly configured for use with two different types of fuels, the heater assembly being selectable between one of the two different types of fuels, the heating assembly comprising:

a first fuel source connection for connecting a first fuel type to the heating assembly;

a second fuel source connection for connecting a second fuel type to the heating assembly;

a main pressure regulator configured to regulate a fluid pressure of a selected fuel flowing through the main pressure regulator to within a pressure range, the main pressure regulator comprising:

a diaphragm having a front side and a back side; and a valve operatively connected to the diaphragm to control the fluid flow through the main pressure regulator on the front side of the diaphragm;

a first auxiliary pressure regulator in fluid communication with the back side of the diaphragm of the main pressure regulator, wherein the first auxiliary pressure regulator directs fuel to the back side of the diaphragm of the main pressure regulator to create a first back pressure on the diaphragm to provide a first pressure range of the main pressure regulator;

a second auxiliary pressure regulator in fluid communication with the back side of the diaphragm of the main pressure regulator, wherein the second auxiliary pressure regulator directs fuel to the back side of the diaphragm of the main pressure regulator to create a second back pressure on the diaphragm to provide a second pressure range of the main pressure regulator; and a flowpath valve configured to allow fluid flow of the first fuel type but not the second fuel type to the second auxiliary pressure regulator.

2. The heating assembly of claim 1, wherein the first auxiliary pressure regulator is in fluid communication with both the front side and the back side of the diaphragm of the main pressure regulator.

3. The heating assembly of claim 1, wherein the first and second auxiliary pressure regulators are in fluid communication with both the front side and the back side of the diaphragm of the main pressure regulator.

4. The heating assembly of claim 1, further comprising an actuation member configured to control the position of the flowpath valve, wherein the actuation member is positioned within the first fuel source connection.

5. The heating assembly of claim 1, wherein the first fuel type is liquid propane and the second fuel type is natural gas.

6. The heating assembly of claim 1, further comprising a burner, and an oxygen depletion sensor, the heating assembly configured such that fuel flowing through the main pressure regulator is selectively directed to the burner, and the oxygen depletion sensor.

7. A heating assembly configured for use with two different types of fuels, the heating assembly being selectable between one of the two different types of fuels and comprising:

a fuel hook-up for connecting fuel to the heating assembly;

a main pressure regulator configured to regulate a fluid pressure of a fuel flowing through the main pressure regulator to within a pressure range, comprising:

a diaphragm having a front side and a back side;

a valve operatively connected to the diaphragm to control the fluid flow through the main pressure regulator on the front side of the diaphragm; and a first auxiliary pressure regulator, wherein the first auxiliary pressure regulator is in fluid communication with the back side of the diaphragm of the main pressure regulator and is configured such that at certain pressures, the first auxiliary pressure regulator directs fuel to the backside of the diaphragm of the main pressure regulator to create a first back pressure on the diaphragm, thereby adjusting the pressure range of the main pressure regulator;

a second auxiliary pressure regulator, wherein the second auxiliary pressure regulator is in fluid communication with the back side of the diaphragm of the main pressure regulator and is configured such that at certain pressures, the second auxiliary pressure regulator directs fuel to the backside of the diaphragm of the main pressure regulator to create a second back pressure on the diaphragm, thereby adjusting the pressure range of the main pressure regulator;

a flowpath valve to control the flow of fluid to the second auxiliary pressure regulator; and an actuation member positioned within the fuel hook-up and connected to the flowpath valve, the actuation member configured such that inserting a fitting into the fuel hook-up moves the actuation member which thereby moves the flowpath valve, allowing fluid to flow to the second auxiliary pressure regulator to create the second back pressure.

8. The heating assembly of claim 7, wherein the first auxiliary pressure regulator is in fluid communication with both the front side and the back side of the diaphragm of the main pressure regulator.

9. The heating assembly of claim 7, wherein the first and second auxiliary pressure regulators are in fluid communication with both the front side and the back side of the diaphragm of the main pressure regulator.

10. The heating assembly of claim 7, wherein the first fuel type is liquid propane and the second fuel type is natural gas.

11. The heating assembly of claim 7, further comprising a burner, and an oxygen depletion sensor.

12. A dual fuel heating assembly comprising:

a main pressure regulator configured to regulate a fluid pressure of a selected fuel flowing through the main pressure regulator to within a pressure range, the main pressure regulator comprising:

a diaphragm having a front side and a back side; and a valve operatively connected to the diaphragm to control the fluid flow through the main pressure regulator on the front side of the diaphragm;

a first auxiliary pressure regulator in fluid communication with the back side of the diaphragm of the main pressure regulator, wherein the first auxiliary pressure regulator directs fuel to the back side of the diaphragm of the main pressure regulator to create a first back pressure on the diaphragm to provide a first pressure range of the main pressure regulator;

a second auxiliary pressure regulator in fluid communication with the back side of the diaphragm of the main pressure regulator, wherein the second auxiliary pressure regulator directs fuel to the back side of the diaphragm of the main pressure regulator to create a second back pressure on the diaphragm to provide a second pressure range of the main pressure regulator; and a flowpath valve configured to allow fluid flow of the first fuel type but not the second fuel type to the second auxiliary pressure regulator.

13. The dual fuel heating assembly of claim 12, wherein the first auxiliary pressure regulator is in fluid communication with both the front side and the back side of the diaphragm of the main pressure regulator.

14. The dual fuel heating assembly of claim 12, wherein the first and second auxiliary pressure regulators are in fluid communication with both the front side and the back side of the diaphragm of the main pressure regulator.

15. The dual fuel heating assembly of claim 12, wherein the first fuel type is liquid propane and the second fuel type is natural gas.

16. The dual fuel heating assembly of claim 12, further comprising an actuation member configured to control the position of the flowpath valve and determine whether or not fluid flow is provided to the second auxiliary pressure regulator to thereby create the second back pressure.

17. The dual fuel heating assembly of claim 16, further comprising a fuel source connection, wherein the actuation member is positioned within the fuel source connection.

18. The dual fuel heating assembly of claim 12, further comprising a burner, and an oxygen depletion sensor.

* * * * *